US008342071B2

(12) United States Patent
Hortobagyi

(10) Patent No.: US 8,342,071 B2
(45) Date of Patent: Jan. 1, 2013

(54) FIREARM FLASH SUPPRESSOR

(75) Inventor: Thomas Hortobagyi, Kitchener (CA)

(73) Assignee: Colt Canada Corporation (CA)

( * ) Notice: Subject to any disclaimer, the term of this patent is extended or adjusted under 35 U.S.C. 154(b) by 128 days.

(21) Appl. No.: 12/470,104

(22) Filed: May 21, 2009

(65) Prior Publication Data

US 2010/0294118 A1 Nov. 25, 2010

(51) Int. Cl.
*F41A 21/34* (2006.01)

(52) U.S. Cl. ..... 89/14.2; 89/14.3; 89/14.4

(58) Field of Classification Search ..... 89/14.2, 89/14.3, 14.4
See application file for complete search history.

(56) References Cited

U.S. PATENT DOCUMENTS

| | | | | | |
|---|---|---|---|---|---|
| 812,140 | A | * | 2/1906 | Kent | 89/14.3 |
| 1,487,312 | A | * | 3/1924 | Bull | 89/14.2 |
| 1,636,357 | A | * | 7/1927 | Cutts, Jr. | 89/14.3 |
| 1,939,700 | A | * | 12/1933 | Hofstetter | 89/14.2 |
| 2,322,370 | A | * | 6/1943 | Lance | 89/14.3 |
| 2,870,679 | A | | 11/1952 | Collins | |
| 2,842,024 | A | * | 7/1958 | Mutter | 89/14.3 |
| 3,141,376 | A | * | 7/1964 | Chinn | 89/14.3 |
| 3,149,532 | A | * | 9/1964 | Pittaway et al. | 89/14.2 |
| 3,179,011 | A | | 4/1965 | Rahm | |
| 3,710,683 | A | | 1/1973 | Kaltmann | |
| 3,733,727 | A | * | 5/1973 | Jones et al. | 42/106 |
| 3,971,285 | A | * | 7/1976 | Ellis et al. | 89/14.3 |
| 4,570,529 | A | | 2/1986 | A'Costa | |
| D285,238 | S | * | 8/1986 | Cellini | D22/108 |
| 4,664,014 | A | * | 5/1987 | Hawley et al. | 89/14.2 |
| 4,852,460 | A | * | 8/1989 | Davidson | 89/14.05 |
| 4,879,942 | A | * | 11/1989 | Cave | 89/14.3 |
| 4,893,544 | A | * | 1/1990 | Hawley et al. | 89/14.2 |
| 4,967,642 | A | * | 11/1990 | Mihaita | 89/126 |
| 5,005,463 | A | | 4/1991 | A'Costa | |
| 5,063,827 | A | * | 11/1991 | Williamson | 89/14.3 |
| 5,092,223 | A | * | 3/1992 | Hudson | 89/14.2 |

(Continued)

FOREIGN PATENT DOCUMENTS

CA 2094048 4/2004

(Continued)

OTHER PUBLICATIONS

IP Australia, Office Action for Australian Patent App. No. 2009202048, Aug. 5, 2010.

(Continued)

*Primary Examiner* — Michael Carone
*Assistant Examiner* — Joshua Freeman
(74) *Attorney, Agent, or Firm* — Cantor Colburn LLP

(57) ABSTRACT

There is provided a flash suppressor for use with a firearm to attenuate muzzle flash. The flash suppressor can be used in conjunction with attachments, and provides mounting and alignment means therefore. In an embodiment, the flash suppressor comprises: a generally cylindrical body having a longitudinal axis, a muzzle end, and an exit end; a passage extending through the body and along the longitudinal axis; and a set of apertures. The passage includes: a mount portion for mounting the flash suppressor to the firearm muzzle; a transition portion; an intermediate portion; and a truncated conical portion having a diameter that increases toward the exit end. The transition portion joins the mount portion and the intermediate portion, and the intermediate portion joins the transition portion and the truncated conical portion. The apertures extend through the body of the flash suppressor and into the truncated conical portion, and channel propellant gases.

15 Claims, 5 Drawing Sheets

U.S. PATENT DOCUMENTS

| | | | | |
|---|---|---|---|---|
| 5,279,200 | A * | 1/1994 | Rose | 89/14.3 |
| 5,303,634 | A | 4/1994 | Warner et al. | |
| 5,320,022 | A * | 6/1994 | Kimbro et al. | 89/14.3 |
| D349,147 | S * | 7/1994 | Gwinn, Jr. | D22/108 |
| 5,357,842 | A * | 10/1994 | Reynolds | 89/14.3 |
| 5,361,677 | A | 11/1994 | Warner et al. | |
| 5,367,940 | A * | 11/1994 | Taylor | 89/14.3 |
| 5,425,298 | A * | 6/1995 | Coburn | 89/14.3 |
| 5,596,161 | A | 1/1997 | Sommers | |
| 5,773,746 | A * | 6/1998 | Vaden | 89/14.4 |
| 5,883,328 | A | 3/1999 | A'Costa | |
| 6,298,764 | B1 | 10/2001 | Sherman et al. | |
| 6,308,608 | B1 * | 10/2001 | Eisenman | 89/14.3 |
| 6,308,609 | B1 | 10/2001 | Davies | |
| D452,722 | S * | 1/2002 | Kay | D22/103 |
| 6,595,099 | B1 * | 7/2003 | Olson et al. | 89/14.2 |
| 6,837,139 | B2 | 1/2005 | Meyers | |
| 6,973,863 | B1 * | 12/2005 | Jones | 89/14.2 |
| 7,000,345 | B1 * | 2/2006 | Kay | 42/75.02 |
| 7,062,874 | B1 | 6/2006 | Smith | |
| 7,594,464 | B2 * | 9/2009 | Dueck | 89/14.4 |
| D605,724 | S * | 12/2009 | Heath | D22/108 |
| 7,676,976 | B2 * | 3/2010 | Dueck et al. | 42/90 |
| 7,735,406 | B1 * | 6/2010 | Olson | 89/14.3 |
| 7,789,009 | B1 * | 9/2010 | Brittingham | 89/14.4 |
| 2003/0106416 | A1 * | 6/2003 | Vais | 89/14.3 |
| 2004/0244571 | A1 * | 12/2004 | Bender | 89/14.3 |
| 2009/0178549 | A1 * | 7/2009 | Meyers | 89/14.2 |

FOREIGN PATENT DOCUMENTS

| | | |
|---|---|---|
| DE | 1185088 | 1/1965 |

OTHER PUBLICATIONS

Canadian Intellectual Property Office, Office Action for Canadian Patent App. No. 2,666,528, May 18, 2011.

* cited by examiner

FIREARM FLASH SUPPRESSOR

FIELD OF THE INVENTION

The present application relates generally to firearms or projectile launching devices. More particularly, the present invention relates to a flash suppressor for reducing the muzzle flash that results from the discharge of a firearm or projectile launching device.

BACKGROUND OF THE INVENTION

The discharge of a firearm produces high temperature propellant gases, which rapidly expand into the surrounding air as they exit the muzzle of the firearm. The propellant gases often carry residual, unburned propellant powder, which may ignite when it mixes with the oxygen-rich ambient air. The resulting combustion produces a flash of light, known as muzzle flash. Muzzle flash can be detrimental to a firearm user, as it can be used to locate the position of the firearm user and may interfere with the firearm's sighting system, particularly in low-light conditions.

A variety of flash suppressors, also known as flash hiders or flash eliminators, have been developed to reduce muzzle flash, including, for example, the flash suppressors disclosed in U.S. Pat. No. 5,596,161 issued to Sommers, U.S. Pat. No. 5,005,463 issued to A'Costa, and U.S. Pat. No. 6,837,139 issued to Meyers. However, there is a need for a flash suppressor that offers improved flash suppression performance, does not significantly increase the length of the firearm, and can be easily mounted to and unmounted from the firearm. Moreover, there is a need for a flash suppressor that can operate with a blank firing attachment, for example, as disclosed in U.S. Pat. No. 5,325,758 issued to Compton et al.

SUMMARY OF THE INVENTION

The present invention is directed toward a flash suppressor that addresses one or more of the above-identified deficiencies. The firearm flash suppressor attaches to the muzzle of a firearm, such as a short-barrelled C9A2 Light Machine Gun, to attenuate muzzle flash by cooling propellant gases as they exit the muzzle of a firearm.

There is provided a flash suppressor for use with a firearm having a firearm muzzle, comprising: a generally cylindrical body having a longitudinal axis, a muzzle end, and an exit end; a passage extending through the body and along the longitudinal axis; and a set of apertures. The passage includes: a mount portion for mounting the flash suppressor to the firearm muzzle; a transition portion; an intermediate portion; and a truncated conical portion having a diameter that increases toward the exit end. The transition portion joins the mount portion and the intermediate portion, and the intermediate portion joins the transition portion and the truncated conical portion. The apertures extend through the body of the flash suppressor and into the truncated conical portion, and channel a portion of the propellant gases.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Figure 1:
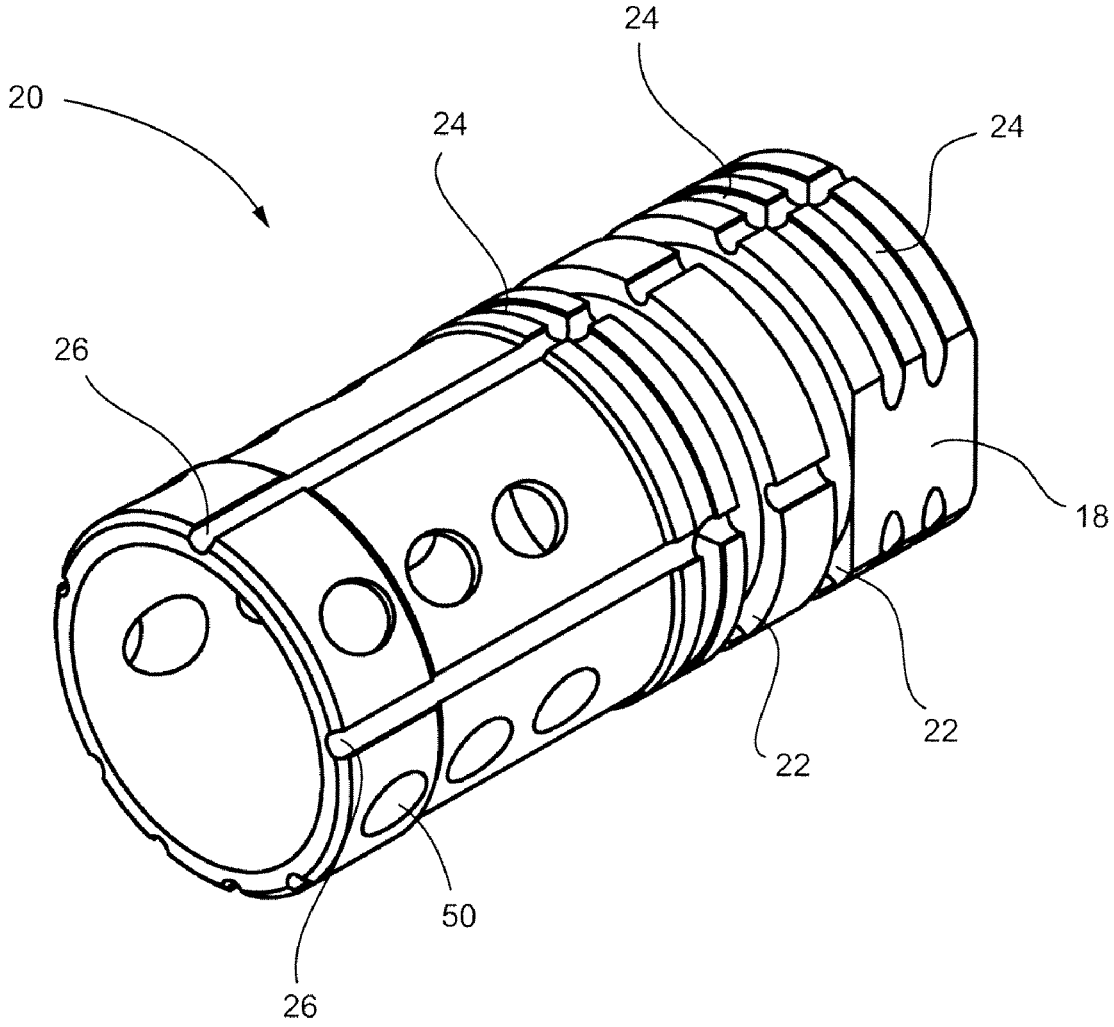
FIG. 1 is a perspective view of an embodiment of the flash suppressor.

FIG. 1 shows an embodiment of a flash suppressor 20 configured for use with a standard firearm, such as a short-barrelled C9A2 Light Machine Gun, having a muzzle. Flash suppressor 20 includes a generally cylindrical body and is mounted to the muzzle, as discussed below. Attachment groove rings 22 and circumferential groove rings 24 are provided on the exterior of the cylindrical body for mounting and alignment of attachments to the flash suppressor 20. Examples of attachments include bayonets, standard blank firing attachments and noise suppressors, also know in the art as compensators.

The addition of attachments, such as a noise suppressor, may result in the build up of carbon, copper, and other materials between the flash suppressor and the attachment after repeated discharges. Longitudinal grooves 26 provide a channel for this debris to evacuate, preventing buildup of the debris and facilitating subsequent removal of the attachment.

Figure 2:
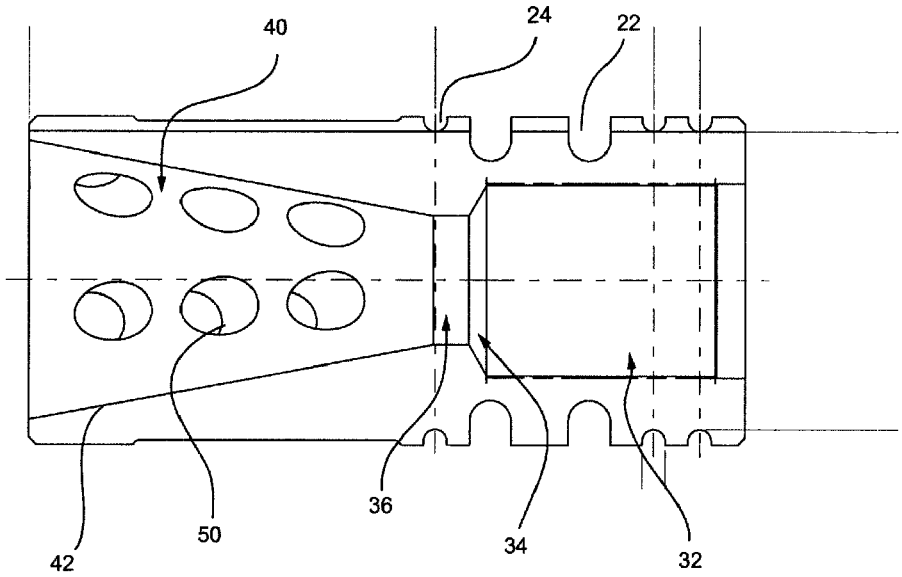
FIG. 2 is a side cross-sectional view of the flash suppressor.

As shown in FIG. 2, the flash suppressor 20 has a longitudinal bore, or passage, that extends through the generally cylindrical body along its longitudinal axis. The bore comprises a mount portion 32, a transition portion 34, an intermediate portion 36, and a truncated conical portion 40. Typically, the mount portion 32 is female-threaded to receive a male-threaded muzzle extension of the muzzle, so that the flash suppressor 20 can be mounted to the muzzle extension. Accordingly, the diameter of the mount portion 32 is selected to fittingly correspond to the exterior diameter of the muzzle extension. A tool can be applied to flattened portions 18, shown in FIG. 1, for applying additional torque during the mounting or unmounting of the flash suppressor 20 to the muzzle. In cases where muzzle the extension is not threaded, mount portion 32 is suitably adapted to receive the muzzle extension.

Transition portion 34 tapers from the diameter of the mount portion to the diameter of intermediate portion 36, which is a generally cylindrical passage sufficiently large to permit the passage of a bullet.

Truncated conical portion 40 has a diameter that is initially equal to the diameter of intermediate portion 36 where the two adjoin, and increases at constant rate away from the muzzle end of the flash suppressor 20, defining tapered surface 42. The tapered surface 42 allows propellant gases to expand and cool while they are still in the flash suppressor 20, such that combustion at the exit of the flash suppressor is significantly reduced.

A set of apertures 50 extends through the cylindrical body and into the truncated conical portion 40. In an embodiment, the apertures slant toward the muzzle end as they progress from the outer surface of the flash suppressor 20 toward the longitudinal axis, and are arranged in four sets of three longitudinally spaced apertures, as shown in FIG. 2. While prior art flash suppressors have used longitudinal slots, the use of apertures 50 in this arrangement enables the flash suppressor 20 to be used in conjunction with a blank firing attachment, such as the type disclosed in U.S. Pat. No. 5,325,758 issued to Compton et al. The apertures 50 are dimensioned and configured to channel a portion of the propellant gases to create a force to counter muzzle lift and to maintain the point of aim. The absence of apertures 50 on the bottom of the flash suppressor 20 reduces the disturbance of particulate matter, such as dust, located below the flash suppressor 20 when the firearm is discharged.

Figure 3:
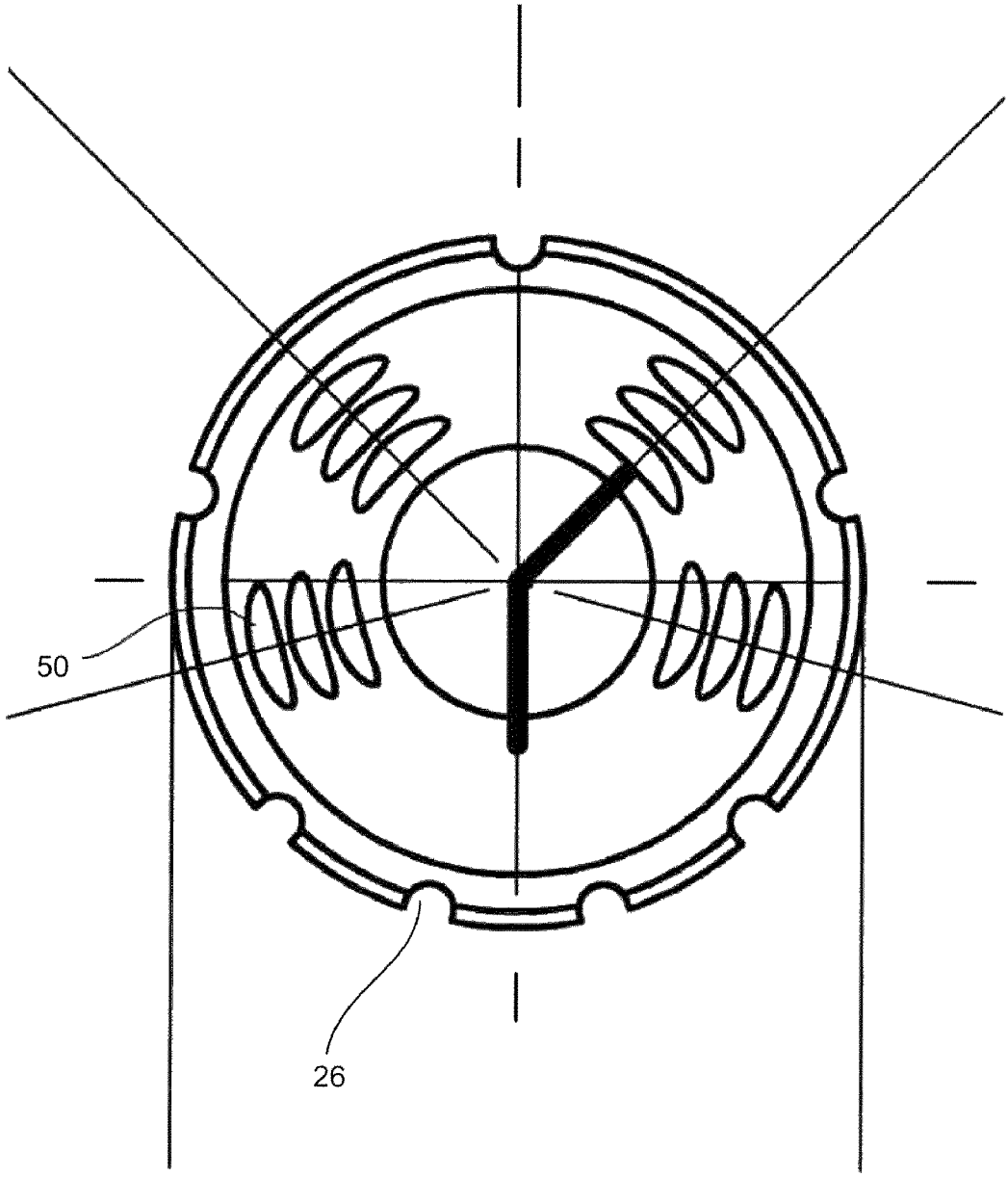
FIG. 3 is a front view of the flash suppressor.

In another embodiment, the flash suppressor 20 is adapted for use with a short-barrelled C9A2 Light Machine Gun, which has a standard bore of 5.56 mm caliber and uses 5.56 mm×45 mm ammunition. In this embodiment the body of the flash suppressor 20 has an exterior diameter between approximately 0.860 inches and 0.864 inches, and overall length between approximately 1.865 inches and 1.885 inches. Attachment grooves 22 are between approximately 0.110 inches and 0.130 inches wide, and have an exterior diameter of between approximately 0.610 inches and 0.630 inches. A first attachment groove 22 begins between approximately 1.150 inches and 1.170 inches from the exit end of the flash suppressor 20. A second attachment groove 22 begins between approximately 1.410 inches and 1.430 inches from the exit end of the flash suppressor 20. Circumferential grooves 24 are between approximately 0.057 inches wide and 0.067 inches wide centered at approximately 1.070 inches, 1.645 inches and 1.765 inches from the exit end of the flash suppressor 20. Circumferential grooves 24 have an exterior diameter of between approximately 0.774 inches and 0.794 inches. As shown in FIG. 3, seven longitudinal grooves 26 extend along the full length of the flash suppressor 20 at approximately 0°±0°30' from the vertical, and 75°±0°30', 135°±0°30' and 165°±0°30' from the vertical in the clockwise and counter-clockwise directions. Each longitudinal groove 26 is between approximately 0.057 inches and 0.067 inches wide.

The mount portion 32 of the flash suppressor 20 extends between approximately 0.680 inches and 0.700 inches into the flash suppressor 20 from the muzzle end, and has a maximum diameter of between approximately 0.510 inches and 0.530 inches. Mount portion 32 has a standard thread that begins between approximately 0.075 inches and 0.076 inches from the muzzle end and extends approximately to the exit end of the mount portion 32. The transition portion 34 is angled at between approximately 58° and 60° from the longitudinal axis of the flash suppressor 20. The intermediate portion 36 has a diameter between approximately 0.338 inches and 0.348 inches. Truncated conical portion 40 has a minimum diameter between approximately 0.338 inches and 0.348 inches and increases at a constant rate along a length of between approximately 1.065 inches and 1.085 inches to a maximum diameter between approximately 0.733 inches and 0.753 inches at the exit end of the flash suppressor 20.

As shown in FIG. 3, apertures 50 are located in four sets of three longitudinally spaced apertures 50 respectively oriented at approximately 45°±1° and 105°±1° in the clockwise and counter-clockwise directions relative to a vertical, upwards reference axis. The apertures 50 slant into the flash suppressor 20 and toward the muzzle end along corresponding aperture axes oriented at approximately 60° from, and extending through, the longitudinal axis of the flash suppressor 20. Measured from a reference axis parallel to the aperture axes and extending through the center of the muzzle end of the flash suppressor 20, the apertures 50 in each longitudinal set of three apertures 50 are respectively located at approximately 0.354 inches, 0.571 inches and 0.788 inches. Each aperture 50 has a diameter of between approximately 0.154 inches and 0.158 inches measured in the plane perpendicular the aperture axis.

In this embodiment, the flash suppressor 20 has demonstrated significant improvement in muzzle flash reduction over standard compensators, such as the standard flash suppressor used with the C9A1 Light Machine Gun.

In an embodiment, the flash suppressor 20 is manufactured from a cold-finished alloy steel such as 4130, 41L30, 4140, 41L40 IAW ASTM A108, heat treated to HRC 26-34 or an equivalent, and applied with a protective finish such as finish 5.3.1.1 of MIL-STD-171, including supplementary oil treatment IAW MIL-PRF-32033 or an equivalent.

Figure 4:
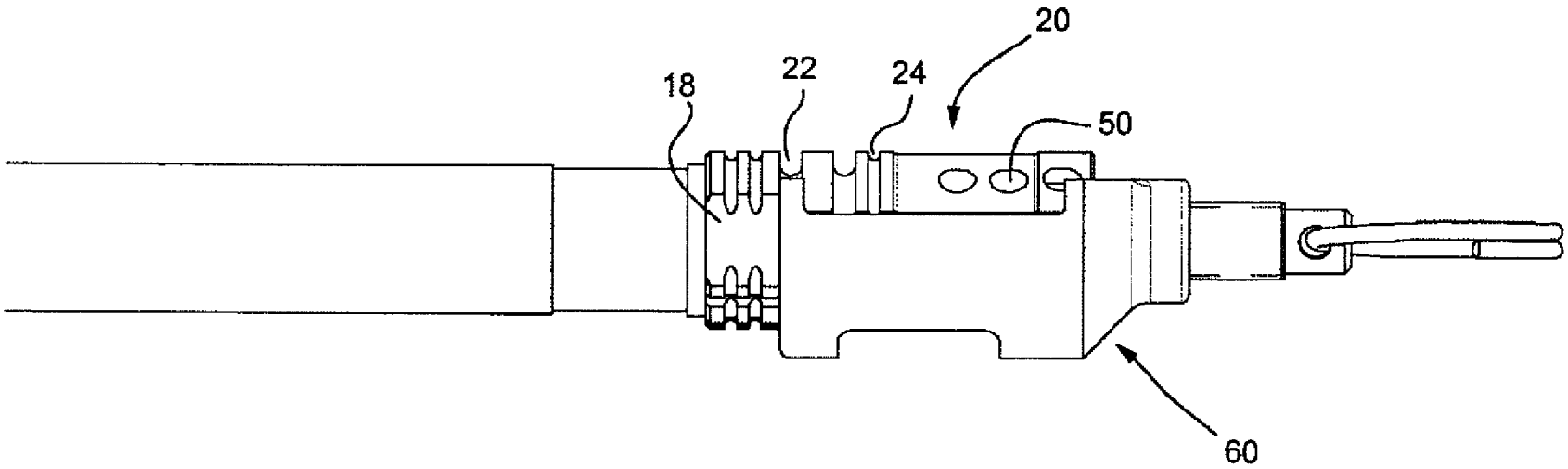
FIG. 4 is a side view of the flash suppressor mounted to a firearm and with an attached blank firing device.
Figure 5:
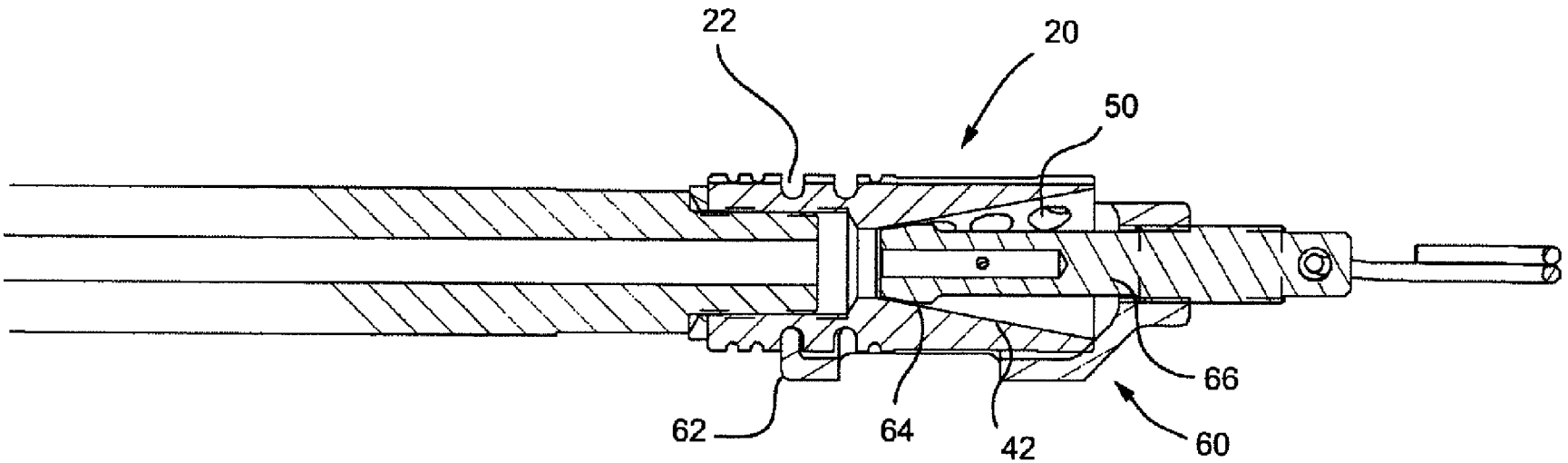
FIG. 5 is a side cross-sectional view of the flash suppressor mounted to a firearm and with an affixed blank firing device.

FIGS. 4 and 5 respectively show a side view and a side cross-sectional view of the flash suppressor 20 mounted on a firearm and with an affixed blank firing device 60. Blank firing attachment 60 is attached to flash suppressor 20 by flange 62 and retractable stem 66. Flange 62 engages attachment groove ring 22, while tapered surface 42 fittingly corresponds to the taper 64 of retractable stem 66 to form a seal.

Embodiments of the invention has been described above, but it will be apparent to a reader skilled in the art that alterations, modifications and variations can be effected to the particular embodiments without departing from the scope of the invention, which is defined solely by the claims appended hereto. For example, it will be understood by persons of ordinary skill in the art that the dimensions may be appropriately scaled for firearms of different calibers.

What is claimed is:

1. A flash suppressor for use with a firearm having a firearm muzzle, comprising:

a generally cylindrical body having a longitudinal axis, a muzzle end, and an exit end;

a passage extending through the body and along the longitudinal axis, the passage having a mount portion for mounting the flash suppressor to the firearm muzzle, a transition portion, an intermediate portion, and a truncated conical portion having a diameter that increases toward the exit end; and a set of apertures extending through the body and into the truncated conical portion for channeling propellant gases, wherein the set of apertures are arranged into a plurality of subsets of apertures each of the plurality of subsets of apertures being radially aligned with each other about the longitudinal axis and each of the plurality of subsets of apertures comprising a plurality of openings longitudinally aligned with each other in a direction towards the muzzle end and wherein each of the plurality of subsets of apertures are parallel to the longitudinal axis and wherein each of the plurality of subsets of apertures slant towards the muzzle end as the progress from an outer surface of the flash suppressor towards the longitudinal axis;

the transition portion joining the mount portion and the intermediate portion, and the intermediate portion joining the transition portion and the truncated conical portion.

2. The flash suppressor of claim 1 wherein the set of apertures comprises four subsets of three longitudinally spaced apertures.

3. The flash suppressor of claim 2 wherein the four subsets of three longitudinally spaced apertures are respectively oriented around the body at between approximately 44 degrees and 46 degrees, and between approximately 104 degrees and 106 degrees in the clockwise direction and approximately 45 degrees and approximately 105 degrees in the counter-clockwise.

4. The flash suppressor of claim 1 wherein each aperture in the set of apertures is centered about an aperture axis, each aperture axis intersecting the longitudinal axis and angled such that the aperture angles toward the muzzle end as it extends into the body.

5. The flash suppressor of claim 1 wherein the mount portion has a maximum diameter of between approximately 0.510 inches and 0.530 inches;

the transition portion is angled at between approximately 58 degrees and 60 degrees relative to the longitudinal axis, the intermediate portion has a diameter of between approximately 0.338 inches and 0.348 inches, and the truncated conical portion has a length of between approximately 1.065 inches and 1.085 inches and a diameter that increases from a minimum diameter of between approximately 0.338 inches and 0.348 inches where it joins the intermediate portion, to a maximum diameter of between approximately 0.733 inches and 0.753 inches at the exit end of the flash suppressor.

6. The flash suppressor of claim 1 wherein the body further comprises an attachment groove for mounting an attachment.

7. The flash suppressor of claim 1 wherein the body further comprises a circumferential groove for mounting an attachment.

8. The flash suppressor of claim 1 wherein the body further comprises a longitudinal groove.

9. The flash suppressor of claim 1 wherein the mount portion is threaded for mounting the flash suppressor to the firearm muzzle.

10. The flash suppressor of claim 1 wherein the body further includes a flattened tool engagement portion.

11. The flash suppressor of claim 1 wherein the body is between approximately 0.860 inches and 0.864 inches in diameter and between approximately 1.865 inches and 1.885 inches in length.

12. The flash suppressor of claim 4 wherein each aperture axis intersects the longitudinal axis at approximately 60 degrees.

13. The flash suppressor of claim 1 wherein the body is manufactured from a cold-finished alloy steel.

14. The flash suppressor of claim 1 wherein the body is heat treated to HRC 26-34.

15. The flash suppressor of claim 1 wherein the body with protected with finish 5.3.1.1 of MIL-STD-171 and supplementary oil treatment IAW MIL-PRF-32033.

* * * * *